US010569444B2

(12) United States Patent
Allen et al.

(10) Patent No.: US 10,569,444 B2
(45) Date of Patent: Feb. 25, 2020

(54) ROTARY CYLINDRICAL ATTACHABLE SLEEVE

(71) Applicant: Dicar, Inc., Pine Brook, NJ (US)

(72) Inventors: Lance Joseph Allen, Klein, TX (US); Stephen Kenneth Warll, New York, NY (US); Douglas Wayne Vaught, Magnolia, TX (US)

(73) Assignee: Dicar, Inc., Pine Brook, NJ (US)

( * ) Notice: Subject to any disclaimer, the term of this patent is extended or adjusted under 35 U.S.C. 154(b) by 0 days.

(21) Appl. No.: 15/550,422

(22) PCT Filed: Feb. 10, 2016

(86) PCT No.: PCT/US2016/017327
§ 371 (c)(1),
(2) Date: Aug. 11, 2017

(87) PCT Pub. No.: WO2016/130659
PCT Pub. Date: Aug. 18, 2016

(65) Prior Publication Data

US 2018/0036899 A1 Feb. 8, 2018

Related U.S. Application Data

(60) Provisional application No. 62/115,310, filed on Feb. 12, 2015.

(51) Int. Cl.

| | |
|---|---|
| ***B26F 1/44*** | (2006.01) |
| ***B26D 7/20*** | (2006.01) |
| ***B26F 1/38*** | (2006.01) |

(52) U.S. Cl.
CPC ..... *B26F 1/44* (2013.01); *B26D 7/204* (2013.01); *B26F 1/384* (2013.01);
(Continued)

(58) Field of Classification Search
CPC ..... Y10T 83/6499; Y10T 83/9312; Y10T 83/4841; Y10T 83/9466; B26D 7/20;
(Continued)

(56) References Cited

U.S. PATENT DOCUMENTS 229,513 A * 7/1880 Allen ..... B24D 5/12
451/544
2,712,205 A * 7/1955 Valette ..... B24D 5/066
451/342

(Continued)

FOREIGN PATENT DOCUMENTS

FR 1003292 3/1952

OTHER PUBLICATIONS

International Search Report for PCT Patent Application No. PCT/US2016/017327 dated Apr. 14, 2016, 11 pages.

*Primary Examiner* — Laura M Lee
(74) *Attorney, Agent, or Firm* — Lowenstein Sandler LLP

(57) ABSTRACT

A sleeve for attaching to a cylindrical platform of a die cutting machine. The sleeve includes a first elastic member and a second elastic member. The sleeve may be arranged in a cylindrical configuration by aligning a first abutting surface of the first elastic member to a second abutting surface of the second elastic member. The first elastic member and the second elastic member can be mounted on a cylindrical platform without the need for a locking mechanism to secure the sleeve onto the cylindrical platform.

10 Claims, 17 Drawing Sheets

(52) U.S. Cl.
CPC ... *B26F 2001/4436* (2013.01); *Y10T 83/4841* (2015.04); *Y10T 83/9312* (2015.04); *Y10T 83/9466* (2015.04)

(58) Field of Classification Search
CPC ..... B26D 2007/202; B26D 7/204; B26F 1/44; B26F 1/384; B26F 2001/4436
USPC ..... 83/659, 347, 698.42; 492/38
See application file for complete search history.

(56) References Cited

U.S. PATENT DOCUMENTS 2,898,854 A * 8/1959 Crawford ..... B41F 27/1231 101/415.1
2,958,903 A * 11/1960 Decker ..... B30B 11/165 100/907
3,180,007 A * 4/1965 Gartz ..... B23K 20/04 492/38
3,285,642 A * 11/1966 Sauer ..... B26D 7/20 292/111
3,522,754 A * 8/1970 Sauer ..... B26D 7/20 83/347
3,577,822 A * 5/1971 Sauer ..... B26D 7/20 101/415.1
3,602,534 A * 8/1971 Dragoo ..... F16D 1/08 403/343
3,668,752 A * 6/1972 Clifton ..... B05C 1/022 492/8
4,031,600 A * 6/1977 Whigham ..... B26D 7/20 492/48
4,073,207 A * 2/1978 Kirkpatrick ..... B26D 7/20 492/48
4,075,918 A * 2/1978 Sauer ..... B26D 7/20 83/347
4,378,737 A * 4/1983 Kirkpatrick ..... B26D 7/20 101/415.1
4,625,612 A 12/1986 Oliver
4,791,846 A * 12/1988 Kirkpatrick ..... B26D 7/20 83/347
4,982,639 A 1/1991 Kirkpatrick
5,906,149 A * 5/1999 Montenegro Criado ..... B26D 7/20 83/346
5,910,203 A * 6/1999 Hauser ..... B23D 57/0053 125/16.01
6,116,135 A * 9/2000 Wagner ..... B26D 7/20 83/659
6,148,725 A * 11/2000 Knauer ..... B41N 6/00 101/217
6,283,902 B1 * 9/2001 Bakoledis ..... B31B 50/00 492/30
6,539,629 B2 * 4/2003 Lai ..... B23K 26/22 29/895.211
7,624,680 B2 * 12/2009 Metrope ..... B41F 27/14 101/375
8,096,239 B2 * 1/2012 Gelbart ..... B41F 27/005 101/375
8,468,921 B2 * 6/2013 Ruhland ..... B26D 1/225 411/307
9,038,238 B2 * 5/2015 Barth ..... F16C 33/14 16/2.1
D799,571 S * 10/2017 Fernandez ..... D15/138
9,874,243 B2 * 1/2018 McKinnon ..... B60B 27/00
2010/0307312 A1 12/2010 Alonso Suarez et al.

* cited by examiner

500

ROTARY CYLINDRICAL ATTACHABLE SLEEVE

CROSS-REFERENCE TO RELATED APPLICATION

This application claims benefit from U.S. Provisional Application No. 62/115,310, entitled "ROTARY CYLINDER SNAP-ON SLEEVE," filed on Feb. 12, 2015, the content of which is incorporated by reference in its entirety.

TECHNICAL FIELD

This disclosure relates to a sleeve including segments that can be mounted on a cylindrical platform without the need for a locking mechanism to secure the segments of the sleeve onto the cylindrical platform.

BACKGROUND

In many situations, a cylindrical sleeve consisting of segments (also referred to as members) that may need to be installed on a cylinder. For example, in the context of a die cutter including a die cylinder and an anvil cylinder, a sleeve may be installed on the die cylinder (a platform for installing cutting blades) via locking mechanisms such as magnetic strips or locking pins to secure segments of the sleeve to the die cylinder. The locking mechanisms are added-on to the sleeve and increase the cost to make the sleeve and the time to install the sleeve on the die cylinder.

BRIEF DESCRIPTION OF THE DRAWINGS

The present disclosure is illustrated by way of example, and not by way of limitation, in the figures of the accompanying drawings.

DETAILED DESCRIPTION

Figure 1:
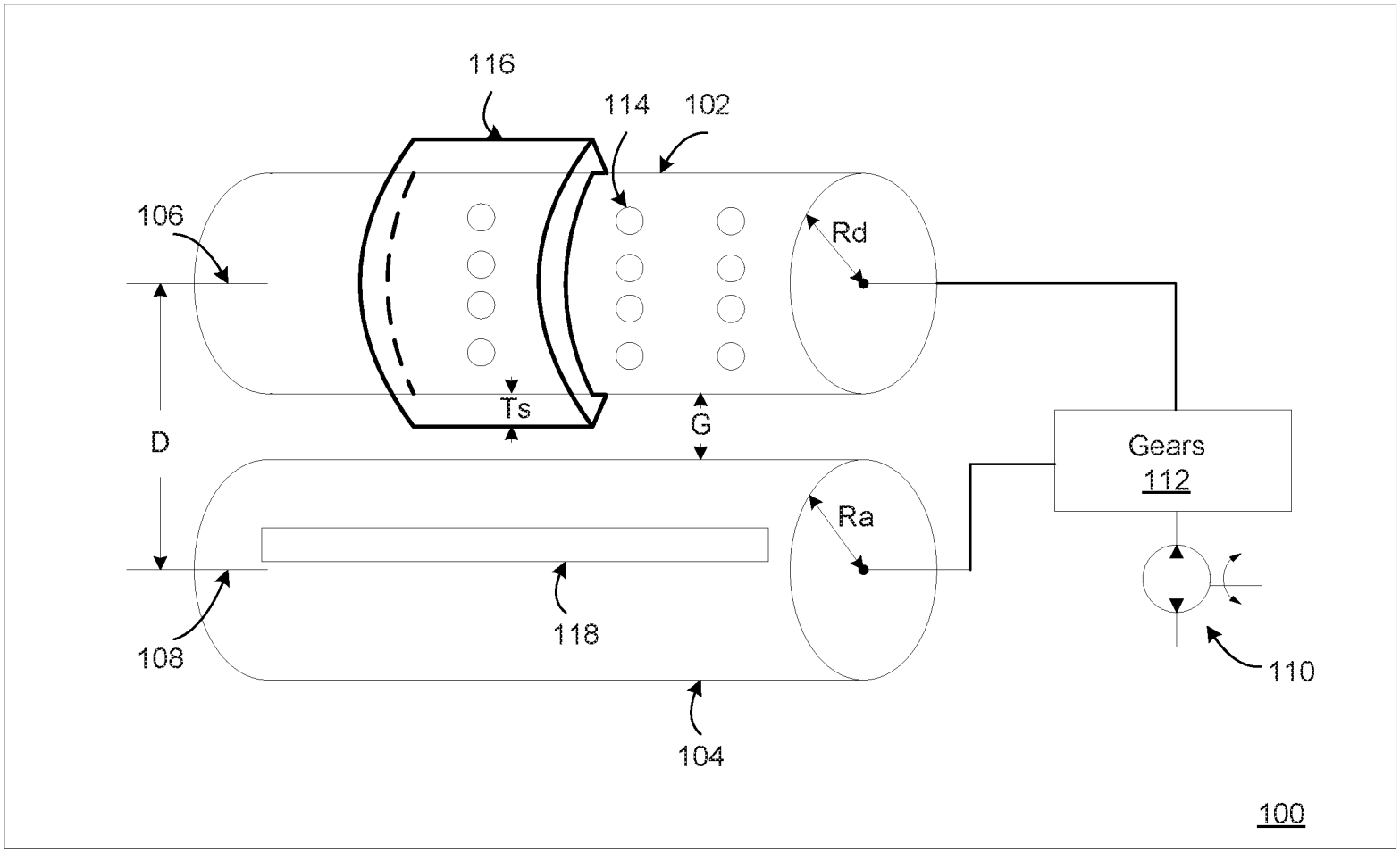
FIG. 1 illustrates a die cutter according to an embodiment of the present disclosure.

A die cutter is a machine that may cut work pieces such as, for example, sheets placed on a platform into certain pre-determined shapes. The platform can be a cylindrical platform (e.g., a cylinder) or a flat platform (e.g., a flatbed). The work pieces can be sheets made from any suitable materials including, such as, corrugated paper, plastic, etc. For example, a rotary die cutter may include a first rotatable cylinder on which cutting blades are installed, and a second rotatable cylinder to provide a support platform to support the sheets to be cut. In this example, the first cylinder is referred to as a die cylinder and the second cylinder is referred to as an anvil cylinder. In some embodiments, the die cylinder and the anvil cylinder may be arranged such that the die cylinder is positioned spatially above (or below) the anvil cylinder. A spatial gap may exist between a lowest contour line of the die cylinder and a highest contour line of the anvil cylinder. One or more motors may drive the die cylinder and anvil cylinder to rotate independently and enable one or more sheets of work pieces to be fed through the spatial gap between the die cylinder and the anvil cylinder via the rotational motion and the frictional force on the surface of the anvil cylinder. Cutting components (e.g., blades or knives) installed on the die cylinder may be programmed to cut work pieces to the pre-determined shapes via the rotational motion of the die cylinder.

Both the die cylinder and the anvil cylinder may be made from hard materials such as steel. During the cutting process, the blades installed on the die cylinder need to cut through the work pieces. To prevent the blades from contacting the hard surface of the anvil cylinder and causing damages to the blades and to the surface of the anvil cylinder, a protective layer (referred to as an anvil cover) may be mounted on the anvil cylinder to serve as a buffer layer between the blade tips and the surface of the anvil cylinder. In operation, the blades may make contact with and cut into the soft anvil cover while avoiding direct contact with the hard surface of the anvil cylinder.

An anvil cover is a protective layer that may be installed on a cylindrical platform, such as the anvil cylinder, to protect the anvil cylinder from direct contact with the cutting blades during die cutting. An anvil cover may be made from durable soft material, such as, for example, Urethane. Since a typical anvil cylinder may have a diameter and a width along the axis direction ranging from approximately 80 to 190 inches, the anvil cover is typically installed in sections of approximately 10 to 20 inches wide. In the present disclosure, the term "anvil cover" and "anvil section" may be used interchangeably. The anvil cylinder may include a horizontal lock channel across the surface of the anvil cylinder. The lock channel may include a groove that is approximately one inch wide and approximately 0.5 inches deep across the full width of the anvil cylinder. Each anvil cover may include a female locking member and a male locking member that may be coupled into the female locking member in the groove to secure the anvil cover to the anvil cylinder.

To install an anvil cover, a human operator typically secures, using bolts or compression force, the female locking member into the lock channel, and then wraps the anvil cover around the surface of the anvil cylinder. After the anvil cover is wrapped around the anvil cylinder, a force is applied to the male locking member of the anvil cover. This is typically done by the operator using a hammer or mallet to drive the male locking member of the anvil cover into the female locking member within the lock channel. A typical anvil cylinder may need approximately 10 to 12 pieces of anvil cover to protect the full width of the anvil cylinder.

Additionally, due to uneven wear, anvil covers are frequently un-mounted, replaced, and reinstalled during the process known as "anvil cover rotation." Anvil cover rotation is designed to distribute the wear on the surface so as to maintain a smoother anvil cover surface and prolong the useful life of the anvil covers. Wrapping the anvil cover around the anvil cylinder can be a difficult task because of the limited access space and physical barriers and impediments such as, for example, various physical structures (e.g., bars and shafts). Also, the anvil covers can be difficult to install because significant force is required from a hammer or mallet to complete the installation process. Further, the process to install the conventional anvil covers may require the operator to place his or her hands between the anvil cylinder and the die cylinder, which can be an occupational hazard.

To help install the anvil covers onto the anvil cylinder, a sleeve of a certain thickness may be mounted onto the die cylinder of the die cutter for reducing the gap between the die cylinder and the anvil cylinder. The sleeve may be wrapped around the die cylinder of the die cutter. The thickness of the sleeve may reduce the spatial gap between the die cylinder and the anvil cylinder to a level that is less than or equal to the thickness of the anvil cover to be mounted on the anvil cylinder. The sleeve may wrap around the die cylinder completely to cover the curved surface of the die cylinder.

When the sleeve is installed on the die cylinder, the die cylinder may serve as a rolling pin to press anvil covers onto the anvil cylinder. To install an anvil cover onto the anvil cylinder, an operator may first secure the female locking member of an anvil cover into the lock channel of the anvil cylinder. Subsequently, one or more motors may supply a driving force to rotate both the die cylinder and the anvil cylinder in opposite rotational directions.

The reduced gap space between the die cylinder and the anvil cylinder may result in the sleeve on the die cylinder applying pressure on the surface of the anvil cover. Thus, the sleeve may apply a persistent force on the surface of the anvil cover through the rotation of the die cylinder. The persistent force applied by the sleeve forces the anvil cover to tightly wrap around the anvil cylinder. When the anvil cylinder makes a complete rotation (e.g., starting from the lock channel where the female locking member of the anvil cover is secured), the male locking member may reach the lock channel. The continued rotations of both the die cylinder and the anvil cylinder cause the sleeve to press the male locking member into the lock channel to enable the male locking member to be coupled with the female locking member. In this way, an anvil cover may be mounted onto an anvil cylinder without the need to manually hammer the male locking member into the lock channel.

The use of cylinders (e.g., die cylinder and anvil cylinder) in the rotary die cut process may require tooling, such as sleeves, dies, printing plates, covers etc., to be mounted in a radial configuration. Typically, locking mechanisms, such as bolts, clamps, magnets, and lock sections, are used to secure various items (e.g., a sleeve) to the cylinders. Certain items can be mounted over a specific feature on the cylinder such as a tapped or slotted hole. The locking mechanisms to install the items on these cylinders, however, can be expensive, and the items can take a longer time to install and operate because of the need to restrict the tooling from sliding and moving on the cylinder.

Embodiments of the present disclosure make it easier to install and un-install various tooling that requires 360° wrapping around onto a cylinder and eliminate the need for a separate locking mechanism associated with the tooling. Instead, embodiments allow for the tooling to be installed by rotating and sliding onto the cylinder. Thus, embodiments of the present disclosure provide the tooling with flexible mountable positions.

Embodiments of the present disclosure provide for the quick and easy installation of tooling (e.g., sleeves) on a cylindrical platform (e.g., the die cylinder or the anvil cylinder of a die cutter). The installation, as described in this disclosure, is safer than using tools to install. The tooling can cover an entire 360° radial section of the cylindrical platform, and can slide freely across the full length of the cylindrical platform. The mounted tooling can remain in place during the operation, withstanding, for example, 200 pounds per linear inch in compressive force against the cylindrical platform (e.g., die cylinder). Because of eliminating the need to the locking mechanism on tooling, embodiments of the present disclosure reduce the cost of tooling and time to install the tooling.

In the following sections, embodiments of the present disclosure are discussed, as an example, in the context of mounting a sleeve onto a die cylinder of a die cutter. However, it is understood that embodiments of the present disclosure are applicable to any suitable tooling mountable on a cylindrical platform.

FIG. 1 illustrates a die cutter 100 according to an embodiment of the present disclosure. As shown in FIG. 1, the die cutter 100 may include a die cylinder 102, an anvil cylinder 104, and a sleeve 116 mountable on the die cylinder 102. Die cylinder 102 and anvil cylinder 104 may be made from any suitable material providing sufficient hardness (e.g., steel) and sleeve 116 may be made from any suitable material that is relatively softer than the die cylinder 102 and anvil cylinder 104 (e.g., wood, plastic, rubber). Sleeve 116 may be mounted onto die cylinder 106 to be used for installing an anvil cover (not shown) on the anvil cylinder 104, and may be removed from the die cylinder 102 during the cutting operation.

The curved outer surfaces of die cylinder 102 and anvil cylinder 104 can be considered to have been formed as the trace of a line rotating in parallel with their respective axis. Thus, each of the die cylinder 102 or the anvil cylinder 104 may include a respective axis 106, 108 that passes through the respective center of cylinders 102, 104. In an embodiment, the axes 106, 108 of the die cylinder 102 and the anvil cylinder 104 are substantially parallel to each other, and are also substantially parallel to the ground. Thus, the die cylinder 102 and the anvil cylinder 104 are in substantially horizontal positions. Assuming that the radii of the die cylinder 102 and the anvil cylinder 104 are represented by $R_d$ and $R_a$, respectively, and that the distance between the axis 106 of the die cylinder 102 and the axis 108 of the anvil cylinder 104 (i.e., the distance from a point on the axis of the die cylinder to the axis of the anvil cylinder) is represented by D. The spatial gap (G) between the die cylinder 102 and the anvil cylinder 104 can be calculated as: $G=D-(R_d+R_a)$.

Since the spatial gap (G) provides room for both the thickness of the anvil cover ($T_a$) and the thickness of a work piece (e.g., a board) ($T_b$) to be cut by the die cutter 100, G is commonly greater than or equal to $T_a+T_b$. The anvil cover and the work piece are not shown in FIG. 1.

In one embodiment, the sleeve 116 may have a thickness ($T_s$) that reduces the spatial gap (G) between the die cylinder 102 and the anvil cylinder 104 by an amount (e.g., represented by the expression to $G-T_s$). In one embodiment, $T_s$ is at least half an inch. The reduced gap space ($G-T_s$) can be less than the thickness of an anvil cover ($T_a$).

The die cylinder 102 and anvil cylinder 104 of the die cutter 100 may be driven by one or more motors 110 through one or more gears 112 to enable cylinders 102, 104 to rotate in opposite rotational directions. For example, if the die cylinder 102 is driven to rotate counter-clockwise, the anvil cylinder 104 is driven to rotate clockwise. The opposite rotational motions between die cylinder 102 and the anvil cylinder 104 cause the work piece (e.g., a board) to be fed horizontally through the gap between the die cylinder 102 and anvil cylinder 104 during die cutting.

The die cylinder 102 may include multiple mounting points 114 at which cutting components (e.g., blades) may be installed. The anvil cylinder 104 may include a lock channel 118 for receiving locking components of an anvil cover. For example, the lock channel 118 may receive a male lock end and a female lock end of the anvil cover coupled in the receptor 118. The anvil cover is securely attached to the anvil cylinder 104 when the male lock end and female lock end are coupled inside the lock channel 118. One or more anvil covers may be installed along the full width of the anvil cylinder 104 to fully or partially cover the surface of the anvil cylinder 104 and prevent the knives or cutting elements installed on the die cylinder 102 from contacting the surface of the anvil cylinder 104.

Figure 2:
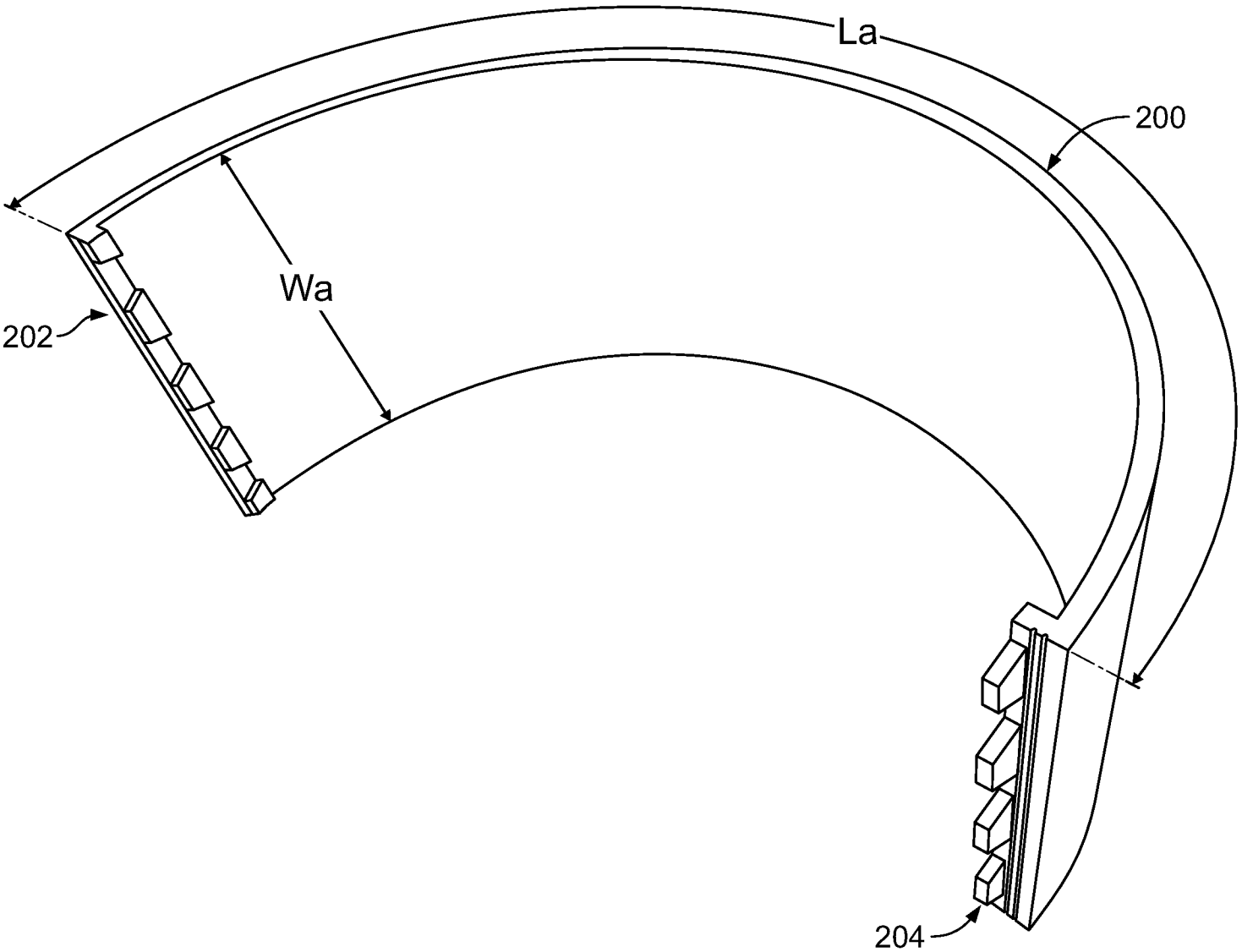
FIG. 2 illustrates an anvil cover that may be used to protect the anvil cylinder according to an embodiment of the present disclosure.

FIG. 2 illustrates an exemplary anvil cover 200 that may be used to cover an anvil cylinder and provide a support platform for the work piece being cut. In an embodiment, the anvil cover 200 is configured to make contact and absorb at least a portion of the cutting components installed on the die cylinder 102. The anvil cover 200 may be made from Urethane or any suitable flexible and soft material. The shape of the anvil cover 200 may be rectangular with a length ($L_a$) and a width ($W_a$). In an embodiment, the length ($L_a$) of the anvil cover 200 may match the circumference of the anvil cylinder 104. When multiple anvil covers are mounted side by side on anvil cylinder 104, the combination of anvil covers can cover all or a portion of the entire anvil cylinder surface. Each anvil cover 200 includes a female lock end 202 and a male lock end 204 both configured to fit into the lock channel 108 on anvil cylinder 104 to secure anvil covers 200 onto the anvil cylinder.

Figure 3A:
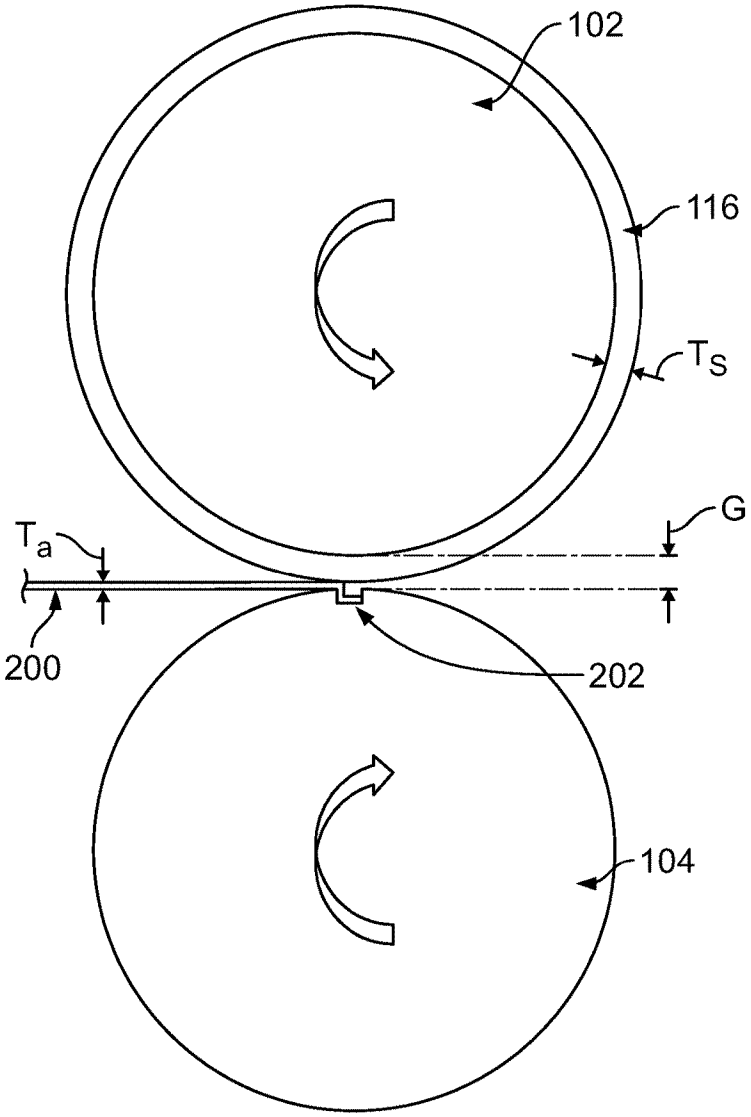
FIGS. 3A-3F illustrate an exemplary process to install an anvil cover onto an anvil cylinder according to an embodiment of the present disclosure.
Figure 3B:
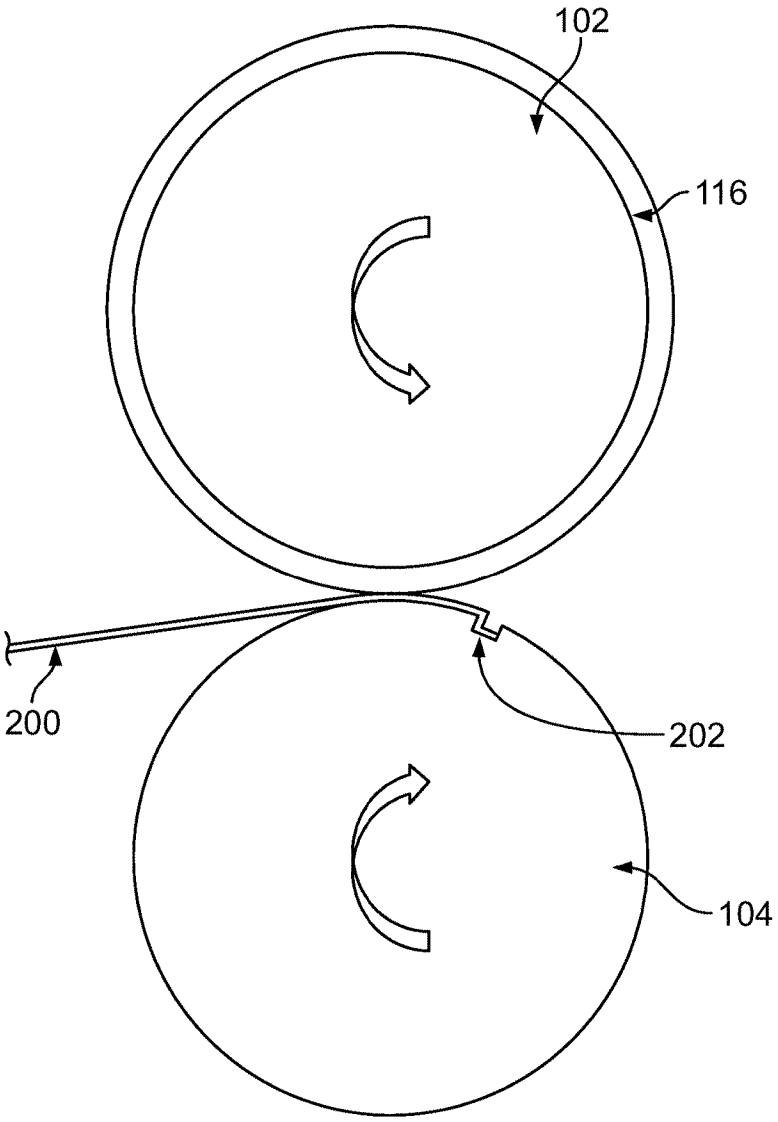
Figure 3C:
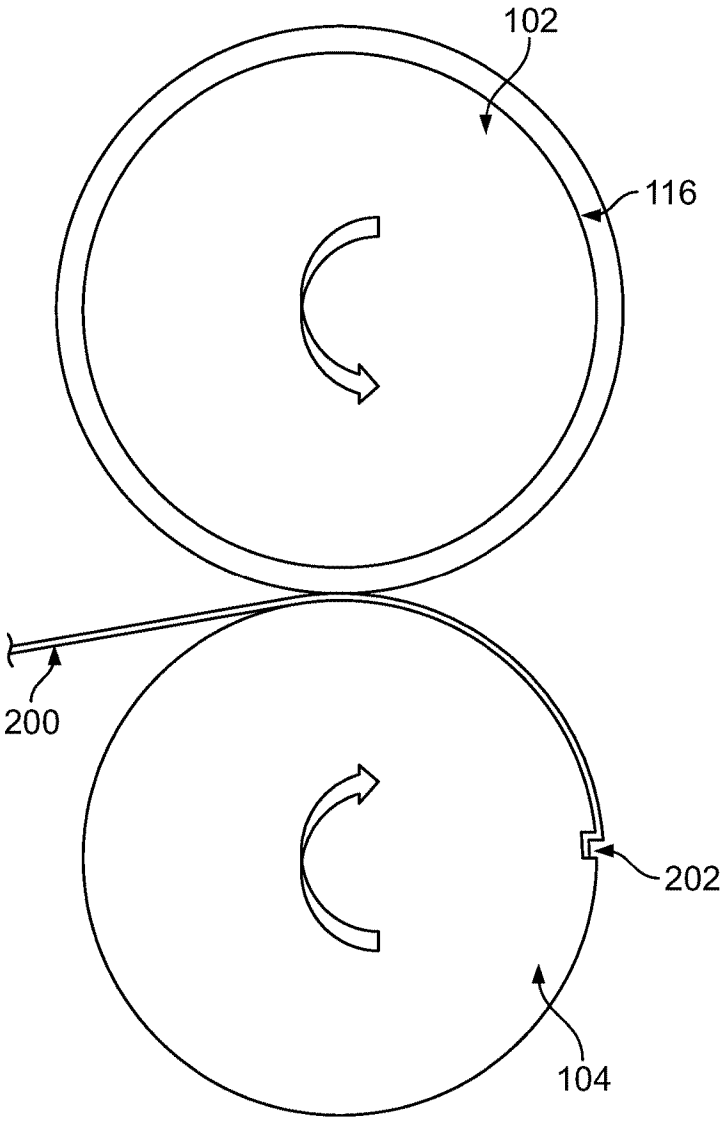
Figure 3D:
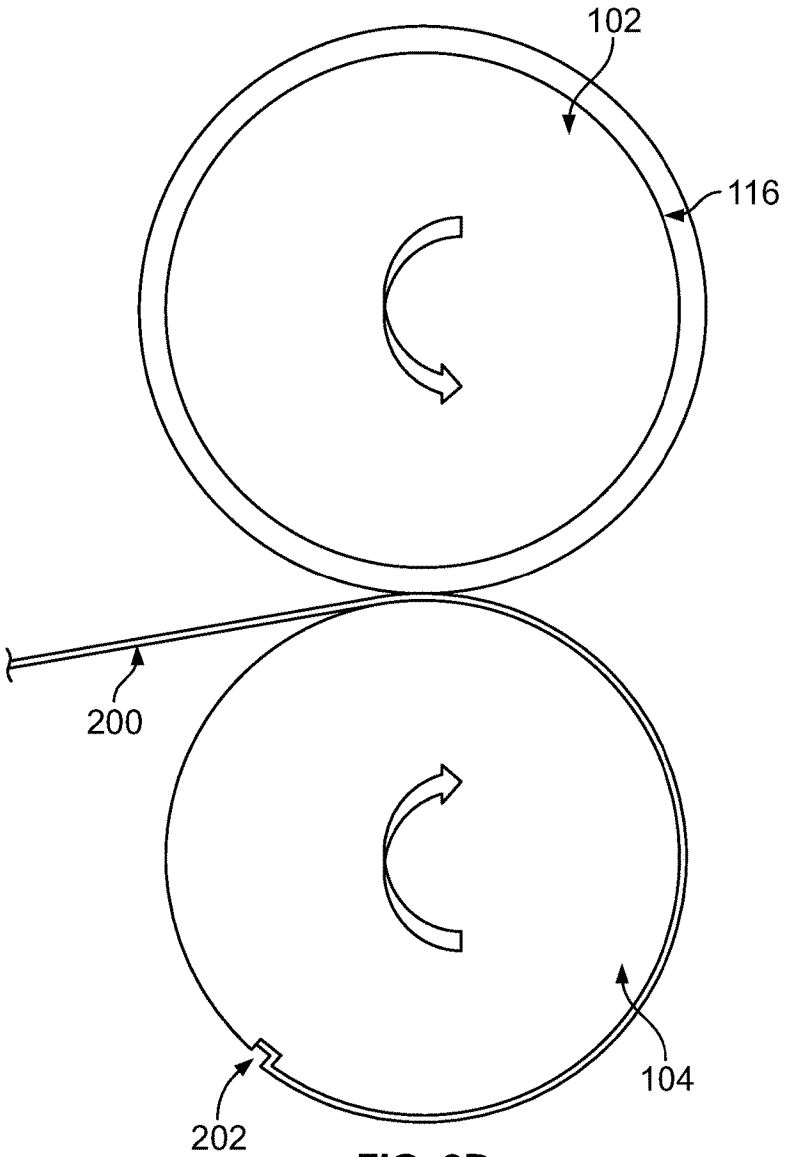
Figure 3E:
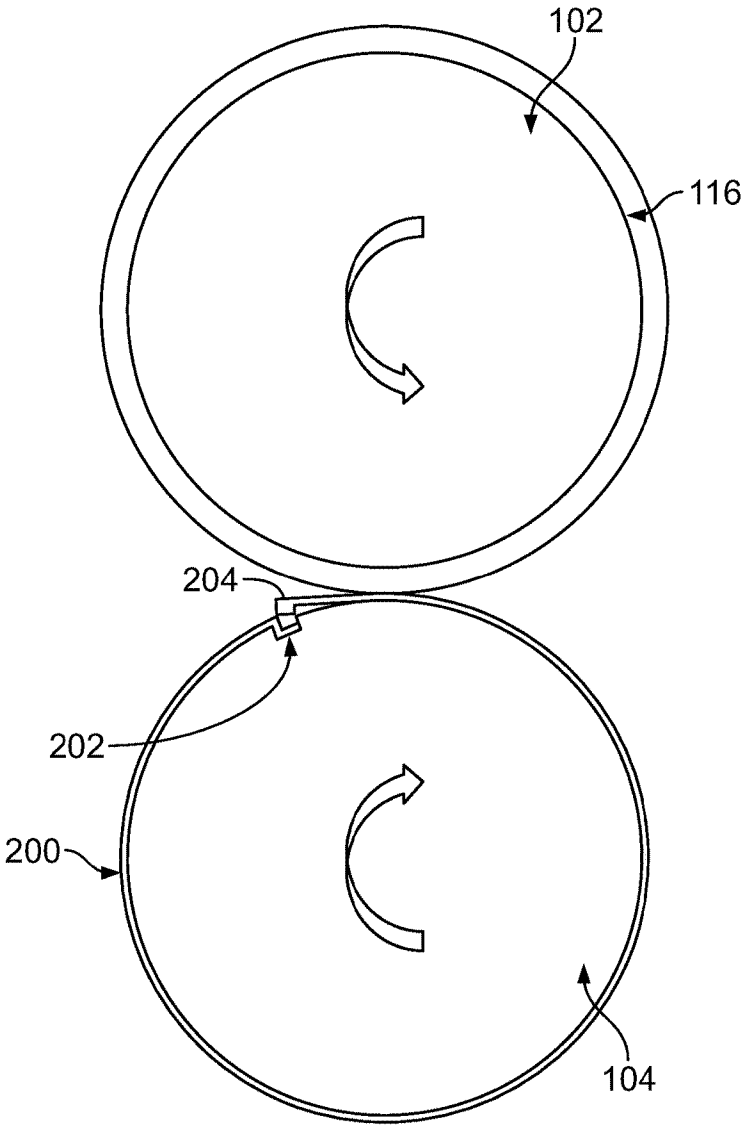

FIGS. 3A-3F illustrate an exemplary method for installing an anvil cover using a sleeve 116 installed on a die cylinder 102 according to an embodiment of the present disclosure. As shown in FIG. 3A, sleeve 116 (having a thickness ($T_s$)) may be installed on the die cylinder 102. The thickness ($T_s$) of the sleeve 116 may fill a portion of the gap (G) between the die cylinder 102 and anvil cylinder 104. In an embodiment, after the sleeve 116 is installed on the die cylinder 102, the gap (G) between the die cylinder 102 and the anvil cylinder 104 is reduced by the thickness ($T_s$) of the sleeve 116, and the reduced gap space may less than or equal to the thickness ($T_a$) of the anvil cover 200 to be mounted on the anvil cylinder 104. In this way, the anvil cover 200 may be installed by rotating (or indexing) the die cylinder 102 and the anvil cylinder 104.

Referring to FIG. 3A, the female lock end 202 of an anvil cover 200 may be secured into lock channel 118 of the anvil cylinder 104. For example, the female lock end 202 may be secured by bolting into the lock channel. Alternatively, the female lock end 202 may be secured by compressing it into the lock channel. After securing the female lock end 202 of the anvil cover 200 into the lock channel, the die cylinder 102 and the anvil cylinder 104 may be driven to rotate in opposite rotational directions. In the example shown in FIG. 3A, the die cylinder 102 rotates counter-clockwise while the anvil cylinder 104 rotates clockwise. Alternatively, only the anvil cylinder 104 is rotated clockwise while the die cylinder 102 is stationary. While rotating, the sleeve 116 on the die cylinder may apply force (e.g., pressuring or squeezing force) onto anvil cover 200 to wrap the anvil cover 200 around the anvil cylinder 104. In an embodiment, the rotational speed of the die cylinder 102 may match the rotational speed of the anvil cylinder 104 to reduce or eliminate stretching along the surface of the anvil cover 200.

Figure 3F:
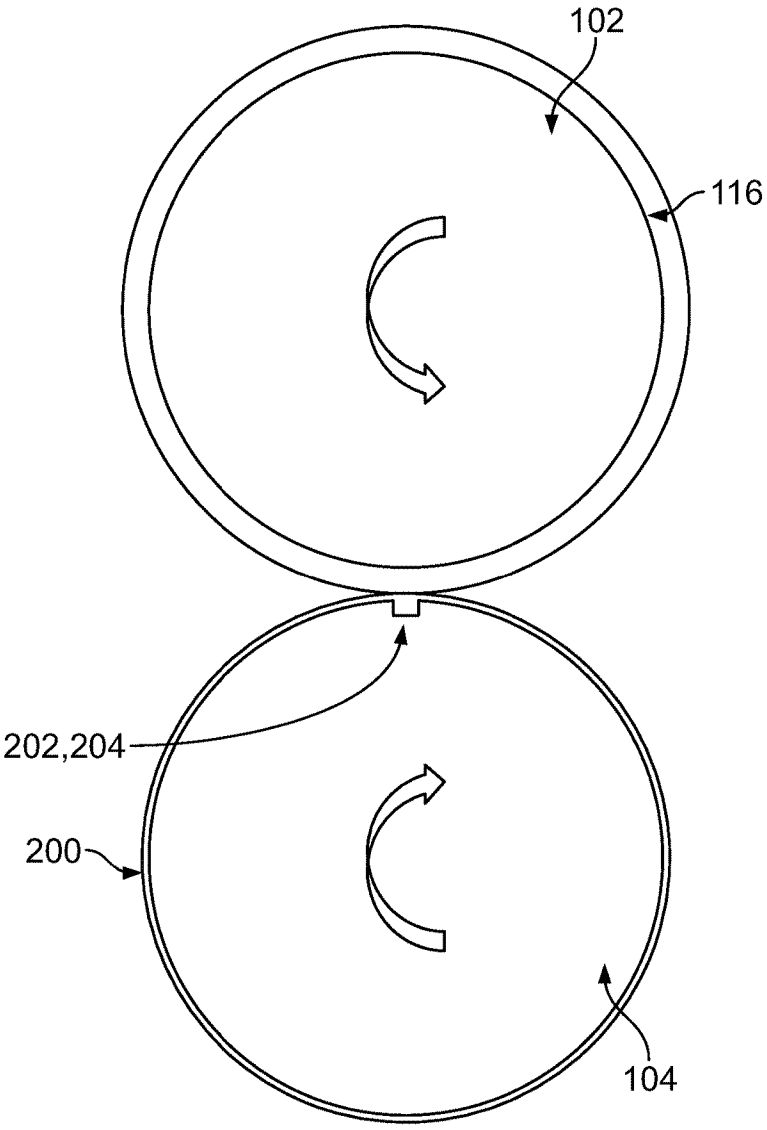

FIGS. 3B-3E illustrate various intermediate points of the process as the die cylinder 102 and the anvil cylinder 104 rotate and the anvil cover 200 is wrapped around the anvil cylinder 104. Since, as discussed above, the length of the anvil cover 200 substantially matches the circumference of the anvil cylinder 104, the male lock end 204 of the anvil cylinder 104 may be pressed by sleeve 116 into the lock channel in which the female lock end 202 is secured. As shown in FIG. 3F after the die cylinder 102 and the anvil cylinder 104 rotate 360° from the lock channel where the female lock end 202 is secured, the male lock end 204 may be forced into the lock channel by the pressing force generated by the rotation of the both die cylinder 102 and the anvil cylinder 104. In this way, an anvil cover 200 may be installed using the rotational movements of the anvil cylinder 104 and the die cylinder 102 without the need for human-aided manual force, such as the hammering of the male lock 204 end into the lock channel.

In an embodiment, the sleeve 116 may be constructed from multiple curved segments. Each segment may cover the full length or a portion of the curved surface of the die cylinder. The sleeve segments may be made from any suitable materials including polyurethane, wood, plastic, rubber, aluminum, steel, or other solid materials.

Figure 4A:
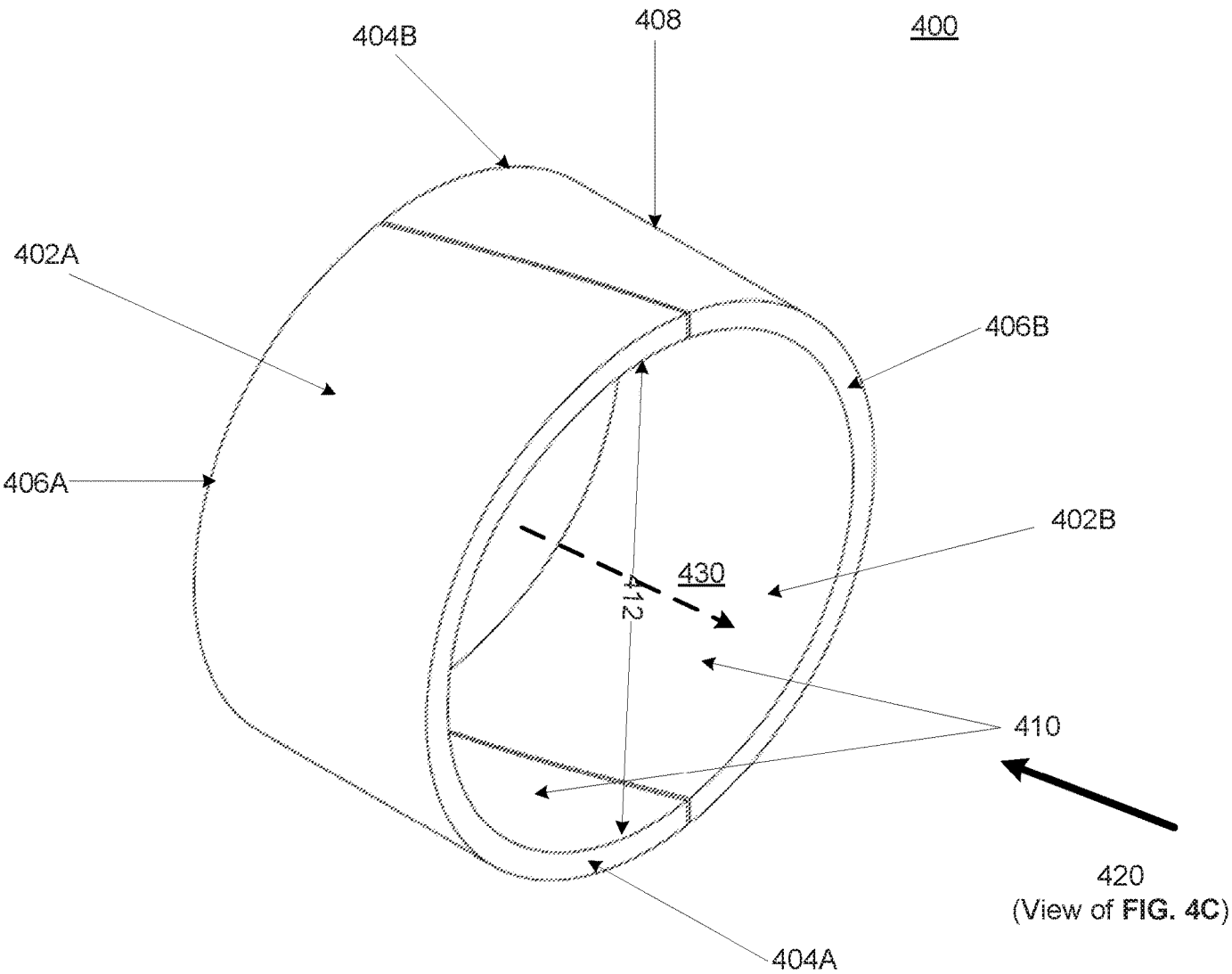
FIGS. 4A-4E illustrate sleeves that can be mounted onto a cylindrical platform according to embodiments of the present disclosure.
Figure 4B:
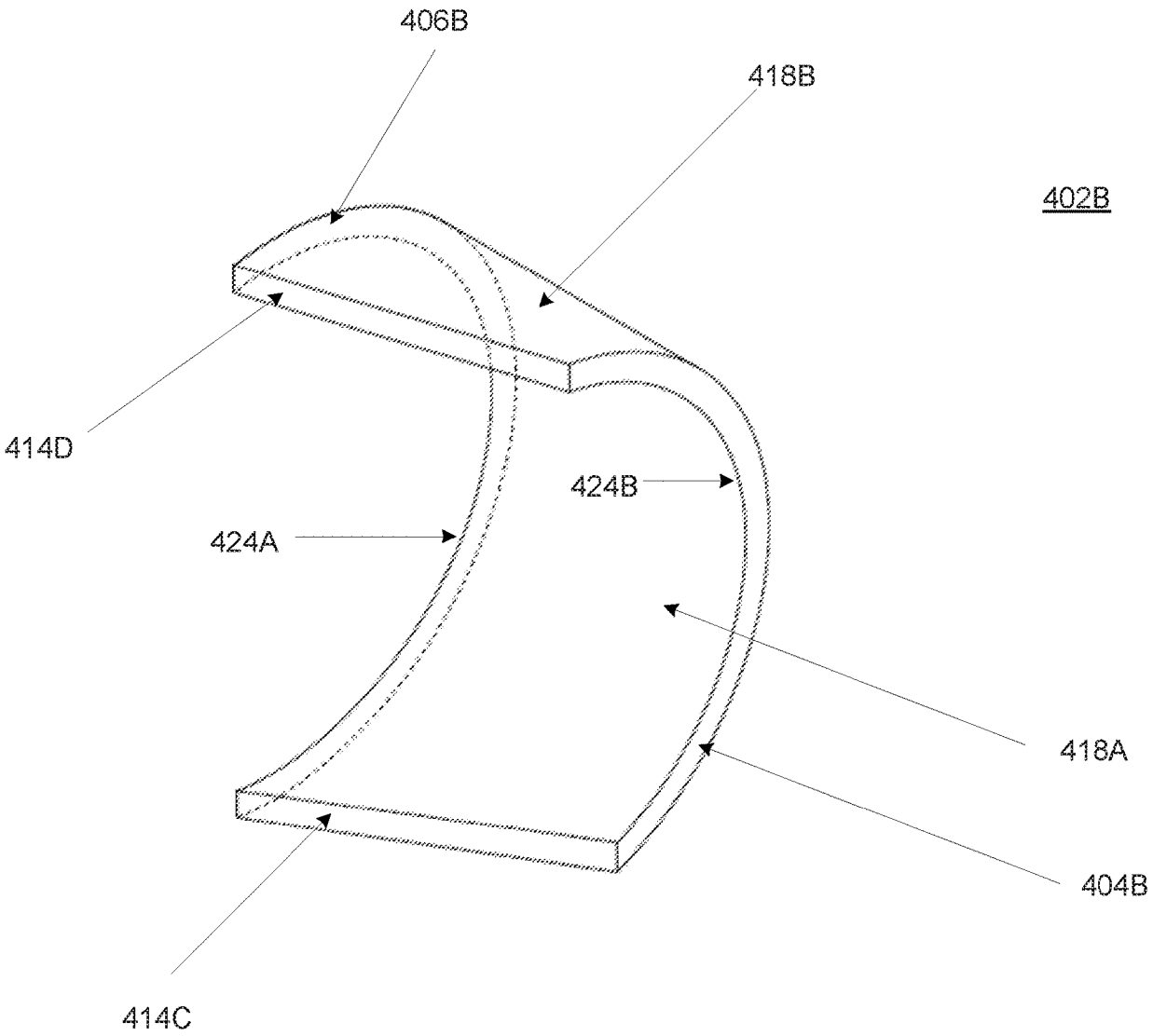
Figure 4C:
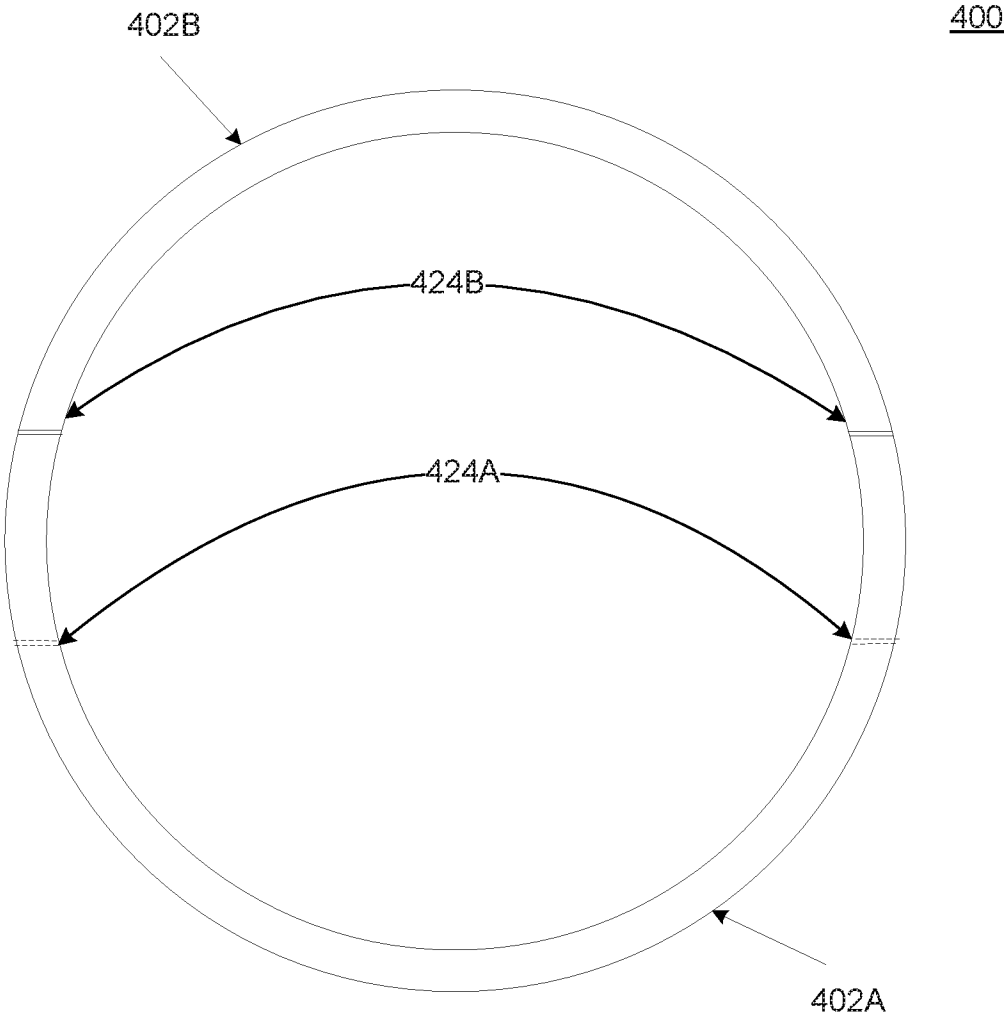

FIGS. 4A-4C show a variety of views of a sleeve 400 formed using sleeve segments according to an embodiment of the present disclosure. FIG. 4A shows a perspective view of the sleeve 400, while FIG. 4C shows a view looking toward a center of the cylindrical sleeve 400. As shown in FIG. 4A, the sleeve 400 may be formed in the shape of a cylindrical sleeve (or a ring-cylindrical layer) including two segments (or members) 402A, 402B. The two segments 402A, 402B, when coupled together by aligning and touching their abutting surfaces, form a hollowed cylinder that may be mounted onto a die cylinder. The hollowed portion of sleeve 400 may include a volume that matches the volume of the die cylinder. In one embodiment, the hollowed cylinder may have a longitudinal axis 430. In an embodiment, each of the sleeve segments 402A, 402B has substantially uniform and substantially equal thickness (e.g., at least half an inch). Sleeve 400 formed by sleeve segments 402, 404 may have an inner diameter 412 that is substantially the same as the diameter of the die cylinder to enable the sleeve 400 to be wrapped around the die cylinder.

As shown in FIG. 4A, sleeve 400 may include an outer convex surface 408 and an inner concave surface 410. When in the cylindrical ring configuration (as shown in FIG. 4A), the sleeve 400 encompasses a cylindrical hollow space that has a diameter 412. The cylindrical hollow space encompassed by the inner surface 410 approximately matches the physical space occupied by the die cylinder. Thus, the sleeve 400 may be mounted on the die cylinder.

In one embodiment, sleeve 400 may have a certain length between two end surfaces composed of the end surfaces of segments 402A, 402B. As shown in FIG. 4A, segment 402A may include two opposite end surfaces 404A, 406A, and segment 402B may include two opposite end surfaces 404B, 406B. Thus, sleeve 400 may include a first end surface (a full circular ring) composed of segment end surfaces 404A, 406B, and a second end surface (a full circular ring) composed of 404B, 406A.

In an embodiment, segment end surfaces 404A, 404B, 406A, 406B may each have an arc length. The arc length of a segment end surface is defined as the length of the curved edge line formed by a segment end surface (i.e., 404A, 404B, 406A, or 406B) intersecting with the inner surface 410. In an embodiment, the segments 402A, 402B are constructed such that the arc length of the end surface 404A of the first segment 402A is longer than the arc length of the second end surface 406A of the first segment 402A or the second end surface 406B of the second segment 402B, and the arc length of the second end surface 404B of the first segment 402A is shorter than the arc length of the first end surface 406A of the second segment 402B. In an embodiment, the arc length of the first end surface 404A of the first segment 402A is greater than half of the circumferential length of the cylindrical hollow space encompassed by sleeve 400, and the arc length of the first end surface 406A of the second segment 402B is greater than half of the circumferential length of the cylindrical hollow space encompassed by sleeve 400. Because each of the segments 402A, 402B includes an arc edge that is greater than half of the circumference of the die cylinder, each segment includes a gap between the ends of an edge that is smaller than the diameter of the die cylinder. The small edge gap prevents segments 402A, 402B, when mounted on the die cylinder, from falling off the die cylinder even if the die cylinder rotates. Thus, each segment 402A, 402B may be mounted onto a die cylinder without the need for a further locking mechanism to secure segments 402A, 402B to the die cylinder.

FIG. 4B shows a perspective view of one segment 402B according to an embodiment of the present disclosure. As shown in FIG. 4B, a segment 402B (and similarly, 402A) is part of a cylindrical sleeve having a certain volume of an elastic material (such as, wood, plastic, rubber, polyurethane, aluminum, or steel). Segment 402B may include six surfaces, including a concave inner surface 418A, the convex outer surface 418B opposite to the concave inner surface 418A, two opposite abutting surfaces 414C, 414D, and two opposite end surfaces 404B, 406B. The concave inner surface 418A may intersect with end surface 422A to form an arc edge line 424A having a first arc length between abutting surfaces 414C, 414D, and intersect with end surface 422B to form an arc edge line 424B having a second arc length between abutting surfaces 414C, 414D. In one embodiment, the first arc length is greater than the second arc length. Namely, the arc line 424A is more than a half circle while arc line 424B is less than a half circle. In one embodiment, abutting surfaces 414C, 414D are planar surfaces formed at an acute angle with respect to end surface 406B so that the axis 430 of the hollowed cylinder encompassed by two cylindrical sleeve segments 402A, 402B is inclined with respect to abutting surfaces 414C, 414D.

FIG. 4C shows a view of the sleeve 400, as viewed from a direction 420 of shown in FIG. 4A, according to an embodiment of the present disclosure. As shown in FIG. 4C, second arc edge 424B of segment 404B may have an arc length that is smaller than that of the first arc edge 424A of segment 402B.

Figure 4D:
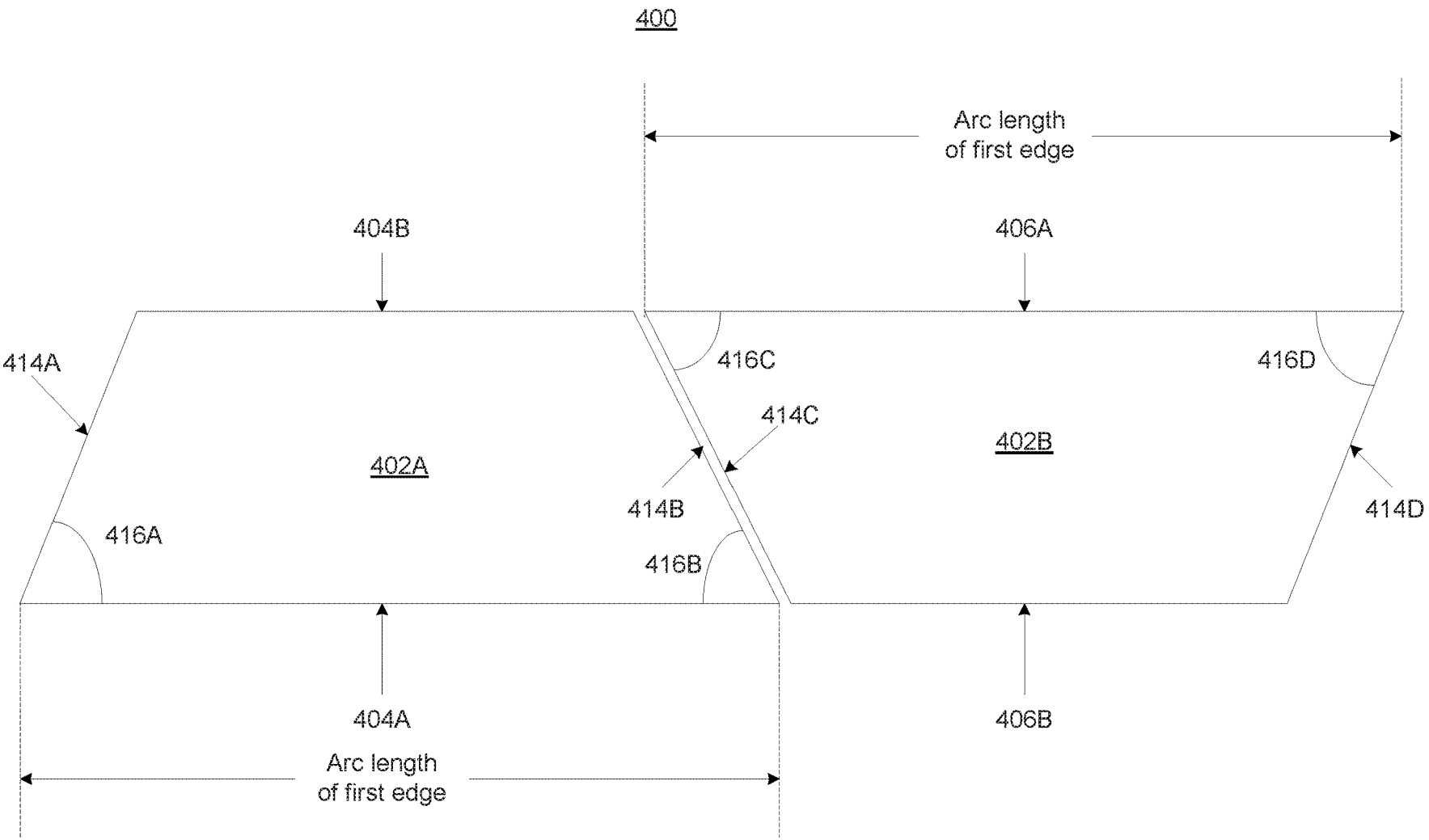
Figure 4E:
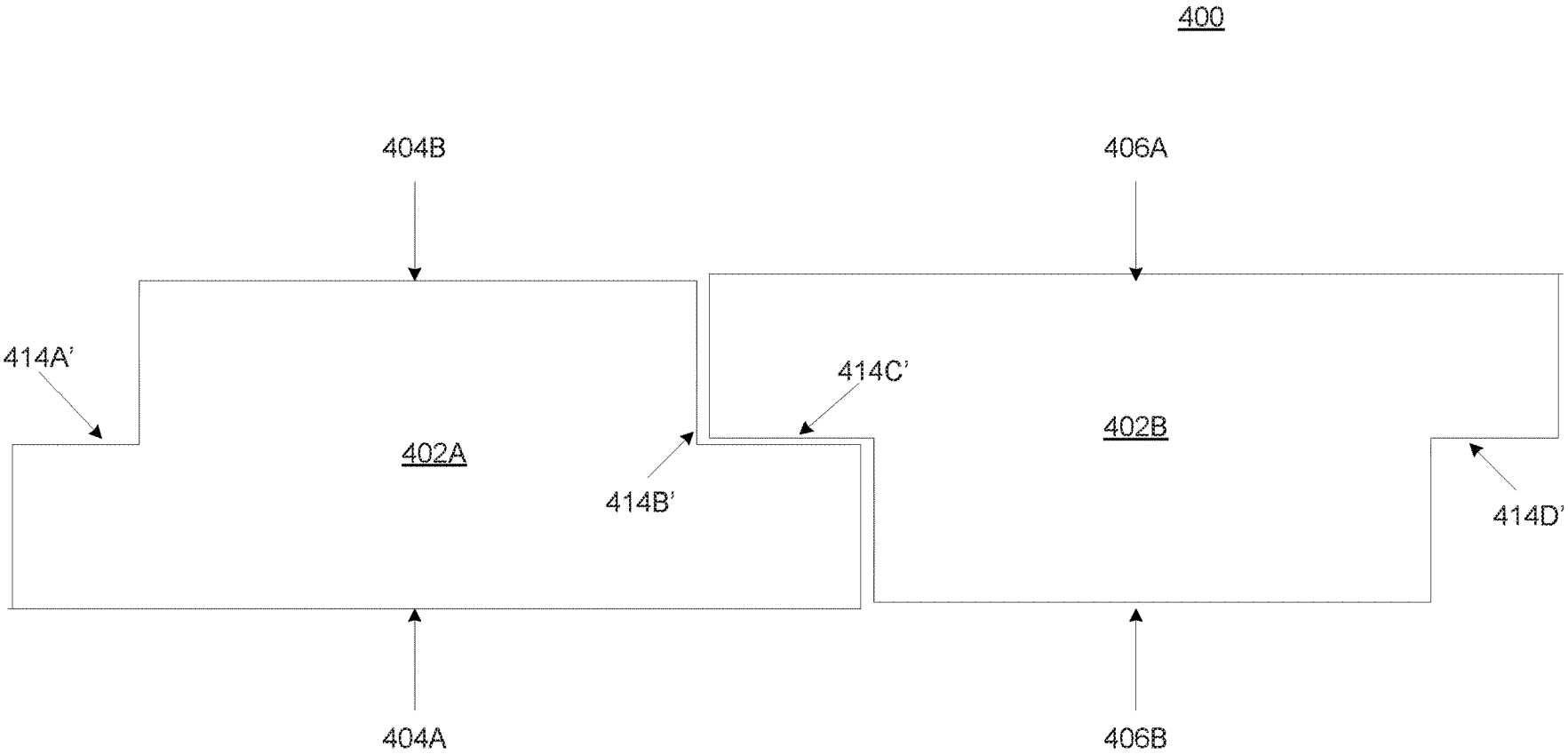

Sleeve segments 402A, 402B are made from elastic materials, and are cursive segments of the cylindrical ring 400. For further illustration, FIG. 4D shows a top view of flattened segments 402A, 402B according to an embodiment of the present disclosure. The top view of the flattened segments is to illustrate the geometrical relationships between the edges of segments 402A, 402B although segments 402A, 402B are normally in cylindrical forms. As shown in FIG. 4D, each segment 402A, 402B includes a long arc end surface 404A, 406A and a short arc end surface 404B, 406B. Further, each segment 402A, 402B may include abutting surfaces 414A-414D that are connecting surfaces between the two segments to form the cylindrical sleeve 400. In one embodiment, abutting surfaces 414A-414D are planar surfaces shown in FIG. 4D. The planar surfaces 414A-414D may form a pairwise match. For example, planar surface 414A substantially matches (or is identical to) planar surface 414D, and planar surface 414B substantially matches (or is identical to) planar surface 414C. In other embodiments, connecting surfaces 414A-414D can be any suitable geometrical shapes as long as they connect the two segments 402A, 402B together to form the cylindrical sleeve 400. For example, FIG. 4E shows a set of stepped connecting surfaces 414A'-414D' that are pairwise complementary to form the cylindrical sleeve 400.

In one embodiment, segments 402A, 402B are substantially identical pieces that can be manufactured using same modules. In another embodiment, segments 402A, 402B are different but complementary pieces.

In one embodiment, the inner diameter 412 of sleeve 400 is selected to be larger than the diameter of the cylindrical platform on which sleeve 400 is to be mounted. For example, in one embodiment, the inner diameter 412 of sleeve 400 may be approximately 0.01 inch greater than the diameter of the cylindrical platform. Thus, if the diameter of the cylindrical platform is 1.71 inches, the inner diameter 412 may be approximately 1.72 inches. The small margins between the inner diameter 412 and the cylindrical platform allow for a surface-to-surface touching between the inner surface 410 of the sleeve 400 and the cylindrical platform on which sleeve 400 is to be mounted. The frictional force due to the surface coupling enables segments of the sleeve 400 to be mounted on the cylindrical platform without the need for additional locking mechanism.

In one embodiment, the abutting surfaces 414A-414D may intersect with the end surfaces 404A, 406A at specified angles 416A-416D. In one embodiment, the angles may be selected from a range of angle degrees. In one embodiment, the angle degrees may be in an approximate range of 5° to 85°. In another embodiment, the range may include angles between 45° to 75°. In one embodiment, angles 416A-416D are the same for the ease to manufacture segments 402A, 402B. In other embodiments, angles 416A-416D may be different to suit the shape of available raw materials.

In one embodiment, angles 416A-416D are determined as a function of the materials used to make sleeve 400. For example, angles 416A-416D may be selected as a function of the flexibility (or rigidity) of the sleeve material. In one embodiment, angles 416A-416D may be proportional to the flexibility of the material, i.e., a smaller angle for a less flexible material and a bigger angle for a more flexible material. In one embodiment, angles 416A-416D may be selected to be 72 degrees.

In one embodiment, the angles 416A-416D are determined by the amount of force (e.g., surface-to-surface frictional force, the inner tension force of the sleeve material) needed to snap the sleeve 400 onto the cylindrical platform. In one embodiment, the design of sleeve 400 allows for easy attachment and remains secure on the platform once the segments of sleeve 400 are snapped on or otherwise secured in place. In one embodiment, sleeve segments made from materials with a high modulus of elasticity, such as steel and aluminum, may include angles 416A-416D that are smaller than those of sleeve segments made from materials with lower modulus of elasticity. In one embodiment, the angles 416A-416D are also determined according to the thickness of sleeve segments because the thickness of sleeve 400 also impacts the force required to expand and deflect the sleeve. Because of the high modulus of elasticity, sleeve segments 402A, 402B can secured onto the underlying cylindrical platform without locking mechanism. Further, according to embodiments, sleeve segments 402A, 402B do not need to be secured to one other.

The angled segments 402A, 402B may allow both segments to be mounted by forcing the cut-open side of the segment onto the die cylinder. In one embodiment, the long end surface 404A of the segment 402A is able to snap on and hold in place because the arc length of the segment 402A is greater than half of the circumference of the die cylinder. Similarly, the segment 402B can snap on in a mirror image fashion onto the die cylinder. Both segments 402A, 402B, when slid and connected together along the touch abutting surfaces, cover the cylinder radially and do not fall off without an external force. In one embodiment, no locking mechanism is needed to secure segment 402A to segment 402B. The combination of segments 402A, 402B on the die cylinder forms the cylindrical sleeve 400.

During and after installation, segments 402A, 402B of sleeve 400 can slide and rotate freely on the cylinder because segments 402A, 402B are not locked to a particular location on the die cylinder. The ease in sliding and rotating segments 402A, 402B allows for the location of sleeve 400 on the cylindrical platform to be changed.

Figure 5A:
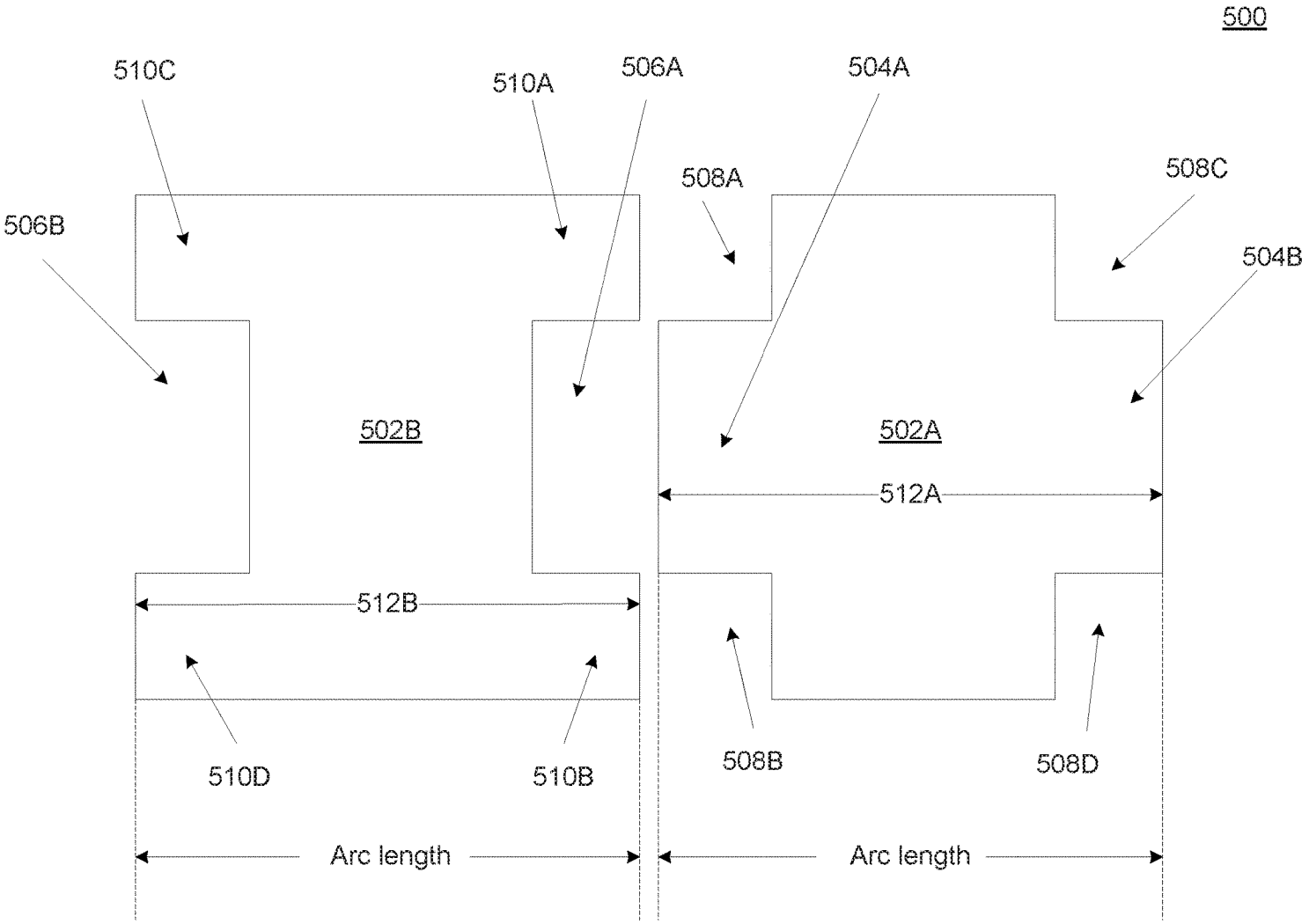
FIGS. 5A-5C illustrate sleeves according to other embodiments of the present disclosure.

In other embodiments, segments of a sleeve may be in other suitable shapes as long as each segment includes a portion whose arc length is larger than half of the circumference of the die cylinder and the segments can be combined to form the sleeve. FIG. 5A illustrates a top view of a flattened sleeve 500 according to another embodiment of the present disclosure. As shown in FIG. 5A, sleeve 500 includes a first segment 502A and a second segment 502B. In one embodiment, first segment 502A includes protrusions 504A, 504B, and correspondingly, second segment 502B is shaped with recesses 506A, 506B to receive protrusions 504A, 504B of first segment 502A. In the same embodiment, second segment 502B also includes protrusions 510A-510D, and correspondingly, first segment 502A also is shaped with recesses 508A-508D to receive protrusions 510A-510D of second segment 502B. In one embodiment, the arc length 512A between an edge of protrusion 504A and an edge of protrusion 504B of segment 502A is greater than half of the circumference of the die cylinder, and the arc length 512B between an edge of protrusion 510A (or 510B) and an edge of protrusion 510C (or 510D) is also greater than half of the circumference of the die cylinder.

Figure 5B:
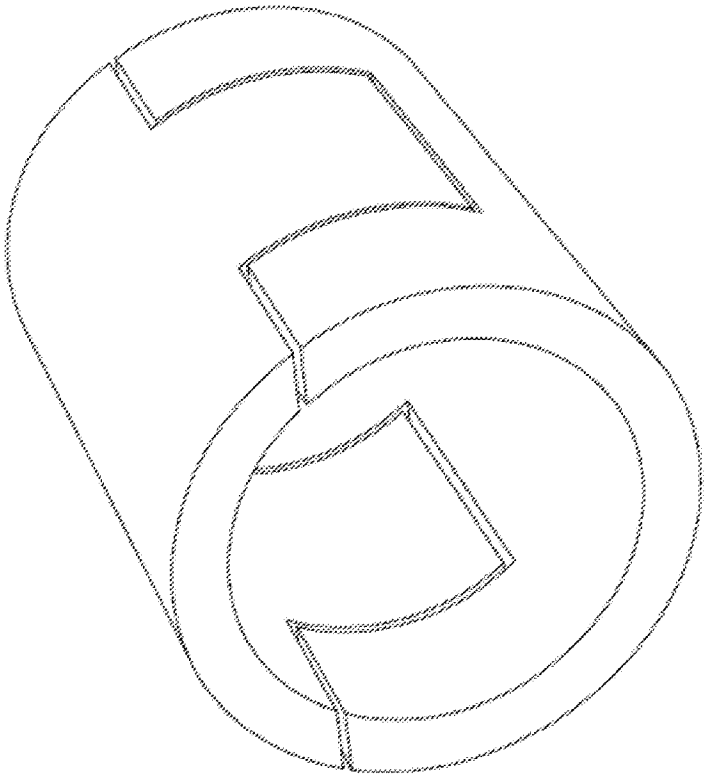

FIG. 5B illustrates a perspective view of sleeve 500 according to an embodiment of the present disclosure. As shown in FIG. 5B, segments 502A, 502B may be wrapped onto a die cylinder. Because each of segments 502A, 502B includes one or more portions whose arc lengths are greater than half of the circumference of the die cylinder, the segments 502A, 502B can be mounted on the die cylinder without the need to use a locking mechanism.

Figure 5C:
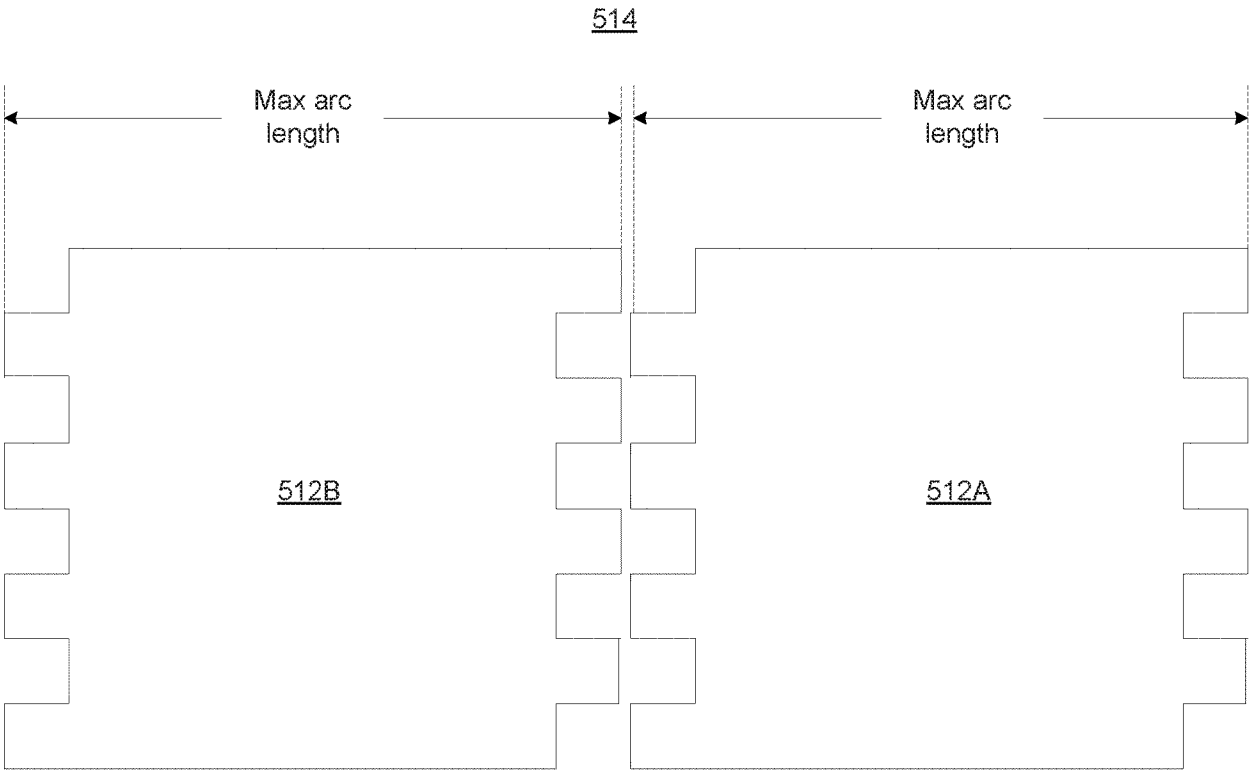

In other embodiments, each segment of a sleeve may include a number of protrusions and be shaped with a number of corresponding recesses. FIG. 5C illustrates a top view of a flattened sleeve 514 according to an embodiment of the present disclosure. As shown in FIG. 5C, sleeve 514 may include segments 512A, 512B. Each of the segments 512A, 512B may include a number of protrusions and recesses to receive the protrusions from a complementary segment. In one embodiment, each segment may be associated with a maximum arc length. The maximum arc length of a segment is the longest arc length between edges of protrusions on a first side of the segment and edges of protrusions on a second side of the segment. In one embodiment, the maximum arc length of each segment is greater than half of the circumference of the cylindrical platform on which these segments are to be mounted.

Figure 6:
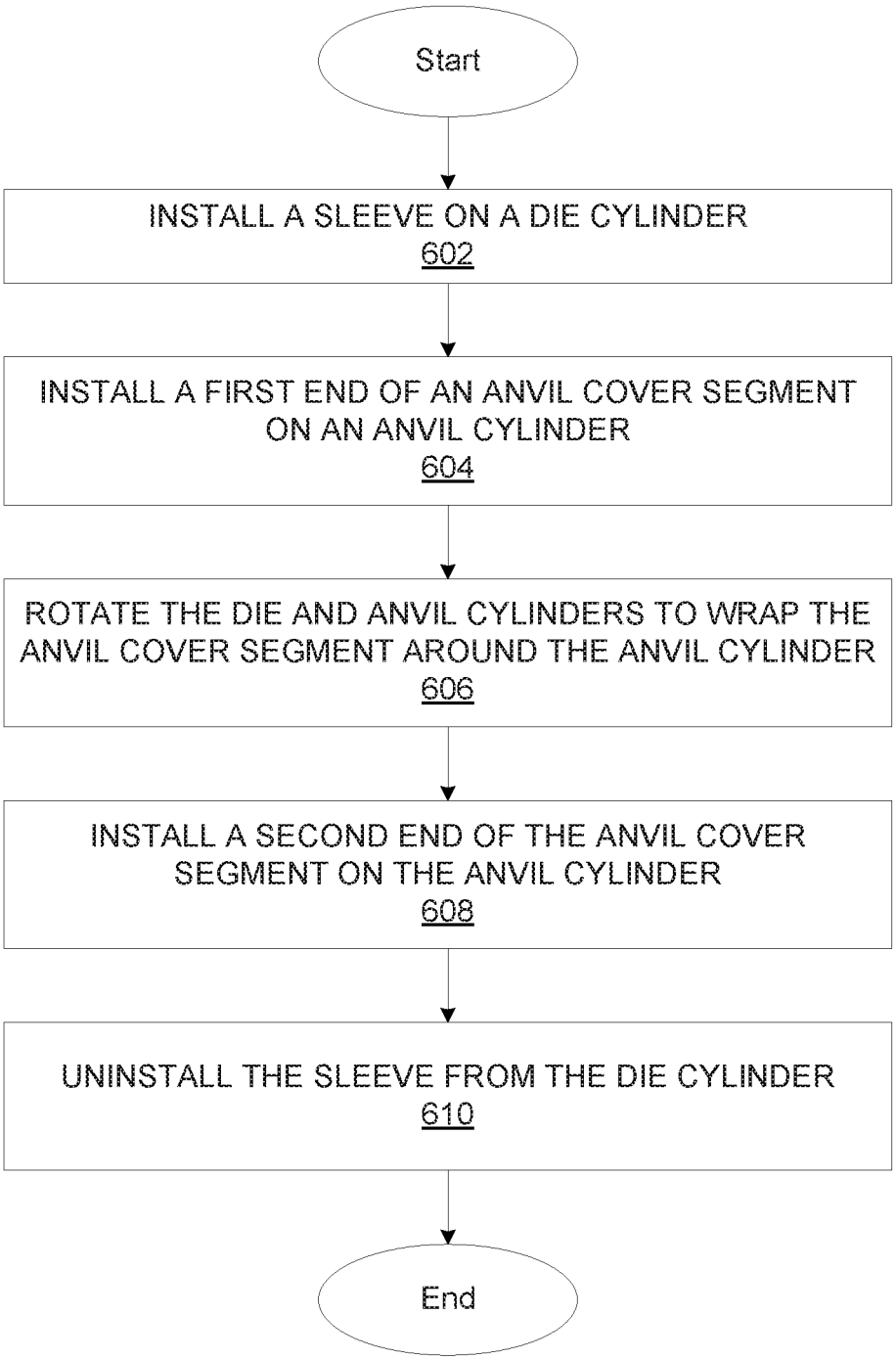
FIG. 6 illustrates a method to install anvil covers according to an embodiment of the present disclosure.

FIG. 6 illustrates an exemplary process 600 for mounting an anvil cover onto an anvil cylinder using a sleeve mounted on a die cylinder according to an embodiment of the present disclosure. As discussed above, a die cutter may include a die cylinder and an anvil cylinder. At the start, cutting blades are not installed on the die cylinder. At 602, a sleeve including two segments as described above in FIGS. 4A-4D may be installed onto the die cylinder. For example, a first segment may be secured or attached onto the die cylinder at a first location, and then a second segment may be secured or attached at a second location. The sleeve segments, when mounted onto the die cylinder, may be rotated and slide towards each other to form a cylindrical ring sleeve that may cover the full length or a portion of the die cylinder. Due to the thickness of the sleeve, the spatial gap (G) between the die cylinder (with the sleeve on) and the anvil cylinder may be reduced to be smaller than the thickness of an anvil cover to be mounted on an anvil cylinder of the die cutter.

At 604, a first end of an anvil cover may be secured to a lock channel on the anvil cylinder of the die cutter. For example, the female lock end of the anvil cover may be compressed into the groove of the lock channel. In an embodiment, the female lock end may be optionally secured or fixedly attached onto the anvil cylinder.

At 606, the anvil cylinder and/or the die cylinder may be rotated either automatically (e.g., driven by one or more motors through a gear box) or manually. While the die cylinder with the sleeve and the anvil cylinder rotate, the anvil cover is pressed by the rolling sleeve installed on the die cylinder to wrap around the anvil cylinder while the unsecured male lock end of the anvil cover may follow until the male lock end meets the female lock end at the nip between the die cylinder and the anvil cylinder. Since there is not enough or no room for the male lock end to pass through the gap between the two cylinders, at 608, the male lock end is forced into the lock channel to lock with the female lock end by force caused from the rolling sleeve.

In an embodiment, the width of the sleeve is substantially the same as or greater than the width of the anvil cover. Therefore, one or more anvil covers may be mounted using one sleeve on the die cylinder.

The one or more anvil covers may be mounted onto the anvil cylinder to completely cover the surface of the anvil cylinder. Once the anvil cover is installed, at 610, the sleeve on the die cylinder may be removed so that cutting components may be installed on the die cylinder for die cutting.

While embodiments are discussed in the context of sleeves mountable on a die cylinder of a die cutter, embodiments may include any suitable segments mountable on any suitable platforms. For example, embodiments may include segments of an anvil cover that are constructed as shown in FIGS. 4A-4E or FIGS. 5A-5C as discussed above in the specification, and the cylindrical platform may be the anvil cylinder of the die cutter. The anvil cover constructed as such may eliminate the need to lock the anvil cover onto the anvil cylinder and thus make the installation of anvil covers easier.

Further, while embodiments of the present disclosure are discussed in the context of cylindrical platforms that include a cylinder whose cross-sections are circular, the cylindrical platforms may include other suitable cursive cylinders. In one embodiment, the cylindrical platform may include cursive cylinders whose cross-sections are substantially circular. In another embodiment, the cylindrical platform may include elliptical cylinders whose cross-sections are ellipses. As such, the sleeves, similar to segments described in FIGS. 4A-4E and FIGS. 5A-5C, may include hollowed cores that match the cylindrical platforms.

The words "example" or "exemplary" are used herein to mean serving as an example, instance, or illustration. Any aspect or design described herein as "example' or "exemplary" is not necessarily to be construed as preferred or advantageous over other aspects or designs. Rather, use of the words "example" or "exemplary" is intended to present concepts in a concrete fashion. As used in this application, the term "or" is intended to mean an inclusive "or" rather than an exclusive "or". That is, unless specified otherwise, or clear from context, "X includes A or B" is intended to mean any of the natural inclusive permutations. That is, if X includes A; X includes B; or X includes both A and B, then "X includes A or B" is satisfied under any of the foregoing instances. In addition, the articles "a" and "an" as used in this application and the appended claims should generally be construed to mean "one or more" unless specified otherwise or clear from context to be directed to a singular form. Moreover, use of the term "an embodiment" or "an embodiment" or "an implementation" or "one implementation" throughout is not intended to mean the same embodiment or implementation unless described as such.

Reference throughout this specification to "an embodiment" or "an embodiment" means that a particular feature, structure, or characteristic described in connection with the embodiment is included in at least an embodiment. Thus, the appearance of the phrases "in an embodiment" or "in an embodiment" in various places throughout this specification are not necessarily all referring to the same embodiment. In addition, the term "or" is intended to mean an inclusive "or" rather than an exclusive "or."

It is to be understood that the above description is intended to be illustrative, and not restrictive. Many other implementations will be apparent to those of skill in the art upon reading and understanding the above description. The scope of the disclosure should, therefore, be determined with reference to the appended claims, along with the full scope of equivalents to which such claims are entitled.

What is claimed is:

1. An apparatus comprising:

a first member comprising:

a first volume of an elastic material; and a first concave surface, a first convex surface opposite to the first concave surface, a first abutting surface, a second abutting surface opposite to the first abutting surface, a first end surface, and a second end surface opposite to the first end surface, the first concave surface intersecting the first end surface to form a first arc line having a first arc length between the first abutting surface and the second abutting surface, the first concave surface intersecting the second end surface to form a second arc line having a second arc length between the first abutting surface and the second abutting surface, wherein the first arc length is greater than the second arc length, and at least one of the first abutting surface or the second abutting surface is a planar surface; and a second member comprising:

a second volume of the elastic material; and a second concave surface, a second convex surface opposite to the second concave surface, a third abutting surface, a fourth abutting surface opposite to the third abutting surface, a third end surface, and a fourth end surface opposite to the third end surface, the second concave surface intersecting the third end surface to form a third arc line having a third arc length between the third abutting surface and the fourth abutting surface, the second concave surface intersecting the fourth end surface to form a fourth arc line having a fourth arc length between the third abutting surface and the fourth abutting surface, wherein the third arc length is greater than the fourth arc length, wherein, when the first and second abutting surfaces are aligned respectively to the third and fourth abutting surfaces, the first member and the second member form a cylindrical sleeve, and wherein the first concave surface and the second concave surface forms an inner surface of the cylindrical sleeve to mount onto a cylindrical platform without locking the first member and the second member to each other.

2. The apparatus of claim 1, wherein the elastic material comprises at least one of wood, plastic, rubber, polyurethane, aluminum, or steel.

3. The apparatus of claim 1, wherein the first member and the second member do not include a locking member to lock the first member to the second member to each other.

4. The apparatus of claim 1, wherein the cylindrical hollow space comprises an axis inclined relative to at least one of the first abutting surface or the second abutting surface of the first member.

5. The apparatus of claim 1, wherein the cylindrical sleeve has a uniform thickness, and wherein the thickness is at least half an inch.

6. The apparatus of claim 1, wherein the second member is geometrically substantially identical to the first member.

7. The apparatus of claim 1, wherein the second member is geometrically different from the first member.

8. The apparatus of claim 1, wherein the first abutting surface of the first member intersects the first end surface of the first member to form a first angle that is less than 90 degrees, and the first abutting surface of the first member intersects the second end surface of the first member to form a second angle that is greater than 90 degrees.

9. The apparatus of claim 8, wherein a value of at least one of the first angle or the second angle is determined as a function of at least one of an elasticity of the elastic material or a thickness of the first member, wherein the thickness of the first member is determined by a distance between the first convex surface and the first convex surface.

10. The apparatus of claim 1, wherein the cylindrical sleeve is to be mounted onto a cylindrical platform of a die cutting machine by installing the first member onto the cylindrical platform at a first position, installing the second member onto the cylindrical platform at a second position to enable the first abutting surface of the first member matching to the third abutting surface of the second member, and sliding the first member toward the second member.

* * * * *